US007982756B2

(12) United States Patent
Chou et al.

(10) Patent No.: US 7,982,756 B2
(45) Date of Patent: Jul. 19, 2011

(54) TIMING CONTROLLER, DISPLAY DEVICE AND METHOD FOR ADJUSTING GAMMA VOLTAGE

(75) Inventors: Chih-Sheng Chou, Taichung (TW); Pi-Lun Chang, Taipei (TW); Hung-Hsiang Chen, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 769 days.

(21) Appl. No.: 12/032,701

(22) Filed: Feb. 18, 2008

(65) Prior Publication Data

US 2009/0058888 A1 Mar. 5, 2009

(30) Foreign Application Priority Data

Aug. 31, 2007 (TW) ..... 96132483 A

(51) Int. Cl.
*G09G 5/10* (2006.01)

(52) U.S. Cl. ..... 345/690; 345/89; 345/99; 345/204

(58) Field of Classification Search ..... 345/690
See application file for complete search history.

(56) References Cited

U.S. PATENT DOCUMENTS

| | | | | |
|---|---|---|---|---|
| 5,986,721 | A * | 11/1999 | Jones et al. | 348/743 |
| 7,081,906 | B2 * | 7/2006 | Kim et al. | 345/690 |
| 7,317,462 | B2 * | 1/2008 | Lu et al. | 345/690 |
| 2005/0174320 | A1 * | 8/2005 | Park | 345/102 |
| 2006/0087521 | A1 * | 4/2006 | Chu et al. | 345/690 |
| 2008/0001897 | A1 * | 1/2008 | Lim | 345/98 |

FOREIGN PATENT DOCUMENTS

CN 200614135 5/2006

* cited by examiner

*Primary Examiner* — Sumati Lefkowitz
*Assistant Examiner* — Ieesha Gillis
(74) *Attorney, Agent, or Firm* — Jianq Chyun IP Office

(57) ABSTRACT

A timing controller is provided. The timing controller comprises a data analyzer, a gain processor, an operator unit and an original gamma voltage generator. The present invention utilizes the data analyzer to analyze a gray level distribution of video data, and then the gain processor selects a gain value. The operator unit converts an original gamma voltage produced by the original gamma voltage generator into an actual gamma voltage according to the gain value. Therefore, the present invention adaptively adjusts the gamma voltage according to the gray level distribution of the video data for increasing display quality.

12 Claims, 6 Drawing Sheets

TIMING CONTROLLER, DISPLAY DEVICE AND METHOD FOR ADJUSTING GAMMA VOLTAGE

CROSS-REFERENCE TO RELATED APPLICATION

This application claims the priority benefit of Taiwan application serial no. 96132483, filed on Aug. 31, 2007. The entirety of the above-mentioned patent application is hereby incorporated by reference herein and made a part of this specification.

BACKGROUND OF THE INVENTION

1. Field of the Invention

The present invention generally relates to a method for adjusting gamma voltage of a display device, and more particularly, to a display device using a method for adjusting gamma voltage in response to dynamic images and a timing controller to implement the above-mentioned method.

2. Description of Related Art

Along with the booming developments on the display device industry, consumers have higher demands on a display device, wherein the requirements on a display product are not only limited to lightweight and compact design, but also producing colorful, clearer and brighter images. Accordingly, the manufactures have been developing various technologies to improve the display quality of a display device to satisfy the modern people.

Taking a thin-film transistor liquid crystal display (TFT-LCD) as an example, it can be seen in FIG. 1 which is a circuit block diagram of a conventional stepping reference voltage device. Referring to FIG. 1, a conventional stepping reference voltage device is mainly composed of a control board 11 and a source driver integrated circuit 12, wherein the control board 11 includes a timing controller (TCON) 113, a resistor-string and buffers 115. The TCON 113 is for receiving video data and exporting the video data accompanying with a proper control signal to the source driver integrated circuit 12.

FIG. 2 is a schematic circuit drawing of a conventional resistor-string and buffers. FIG. 3 is a figure showing a fixed-mode gamma curve in the prior art. Referring to FIGS. 2 and 3, the stepping reference voltages of a conventional TFT-LCD are usually produced by dividing voltages of a resistor-string, wherein the stepping reference voltages are unchangeable due to the fixed resistors in series connection. In addition, only a set of stepping voltages corresponding to a gamma characteristic curve is provided to the source driver integrated circuit 12 in the prior art, following by outputting the provided stepping voltages from the source driver integrated circuit 12 to a panel 21.

It can be seen from the above description that because the voltage-dividing resistances of the resistor-string and buffers 115 are fixed, the resulting gamma characteristic curve is unchangeable as well. Therefore, regardless of any changed image, the source driver integrated circuit 12 performs a gamma correction based on a fixed-mode gamma characteristic curve as shown by FIG. 3 only. As a result, the prior art is unable to appropriately adjust a gamma curve to adapt the actual and dynamic image display characteristics. In short, the conventional architecture is disadvantageous in failing to perform a proper gamma compensation in response to a dark-shift image or a bright-shift image, which largely reduces the expected display quality.

Based on the above described, the related panel manufactures are eager to find out a solution to overcome the above-mentioned problems.

SUMMARY OF THE INVENTION

Accordingly, the present invention is directed to a timing controller (TCON) which is able to select different gain values according to the dark/bright extent of video data so as to convert original gamma voltages into actual gamma voltages for better display quality.

The present invention is also directed to a display device capable of adjusting gamma voltages according to the gray level distribution of video data for improving the display quality of a display device.

The present invention is also directed to a method for adjusting gamma voltage which selects different gain values according to the gray level distribution of video data and then converts original gamma voltages into actual gamma voltages according to the gain values so as to improve over-bright or over-dark images.

The present invention provides a timing controller, which includes a data analyzer, a gain processor, an original gamma voltage generator and an operation unit. The data analyzer dynamically analyzes the gray level distribution of an image of video data to judge the dark/bright extent of the image. The gain processor is coupled to the data analyzer for selecting a gain value according to the dark/bright extent of an image. The original gamma voltage generator provides original gamma voltages. The operation unit is coupled to the gain processor and the original gamma voltage generator for calculating actual gamma voltages according to the gain value and the original gamma voltages to a stepping voltage generator.

In an embodiment of the present invention, the stepping voltages are coupled to a timing controller, the stepping voltage generator produces stepping voltages according to actual gamma voltages for mapping and converting the video data into driving voltages. In another embodiment, the above-mentioned data analyzer in the timing controller performs a statistics on the gray level distribution of an image to obtain a ratio of the data amount of the dark gray level regions over the whole data amount of the image and a ratio of the data amount of the bright gray level regions over the whole data amount of the image so as to judge the dark/bright extent of the image.

The present invention provides a display device, which includes a data analyzer, a gain processor, an original gamma voltage generator, an operation unit, a stepping voltage generator, a driving circuit and a panel. The data analyzer dynamically analyzes the gray level distribution of an image of video data to judge the dark/bright extent of the image. The gain processor is coupled to the data analyzer for selecting a gain value according to the dark/bright extent of an image. The original gamma voltage generator provides original gamma voltages. The operation unit is coupled to the gain processor and the original gamma voltage generator for calculating actual gamma voltages according to the gain value and the original gamma voltages. The stepping voltage generator produces a stepping voltage according to an actual gamma voltage. The driving circuit is coupled to the stepping voltage generator and maps and converts the video data into driving voltages. The panel is coupled to the driving circuit to receive driving voltages to display an image.

The present invention provides a method for adjusting gamma voltage, the method includes following steps. In step A, the gray level distribution of an image of video data dynamically analyzed so as to judge the dark/bright extent of the image. In step B, a gain value is selected according to the dark/bright extent of the image. In step C, an original gamma voltage is provided. In step D, an actual gamma voltage is calculated according to the gain value and the original gamma voltage.

In an embodiment of the present invention, the step A further includes a step of performing a statistics on the gray level distribution of an image to obtain a ratio of the data amount of the dark gray level regions over the whole data amount of the image and a ratio of the data amount of the bright gray level regions over the whole data amount of the image so as to judge the dark/bright extent of the image.

Because the present invention employs a data analyzer to analyze the gray level distribution of video data followed by selecting a gain value by a gain processor, an operation unit is employed to convert an original gamma voltage into an actual gamma voltage according to the gain value. And a stepping voltage generator is used to produce a stepping voltage according to the actual gamma voltage; therefore, the gamma voltage can be adaptively adjusted according to the gray level distribution of video data with better display quality.

BRIEF DESCRIPTION OF THE DRAWINGS

The accompanying drawings are included to provide a further understanding of the invention, and are incorporated in and constituted a part of this specification. The drawings illustrate embodiments of the invention, and together with the description, serve to explain the principles of the invention.

DESCRIPTION OF THE EMBODIMENTS

Figure 1:
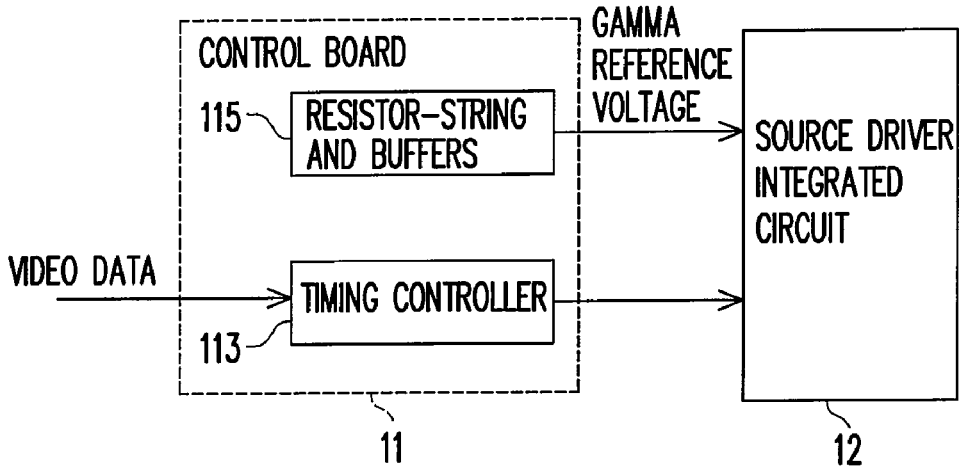
FIG. 1 (PRIOR ART)
FIG. 1 is a circuit block diagram of a conventional stepping reference voltage device.
Figure 2:
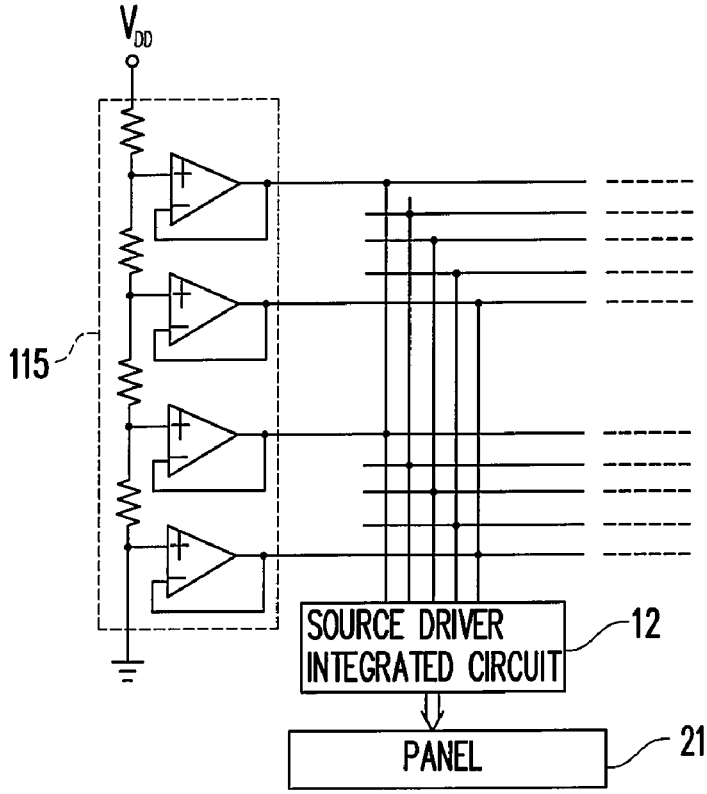
FIG. 2 (PRIOR ART)
FIG. 2 is a schematic circuit drawing of a conventional resistor-string and buffers.
Figure 3:
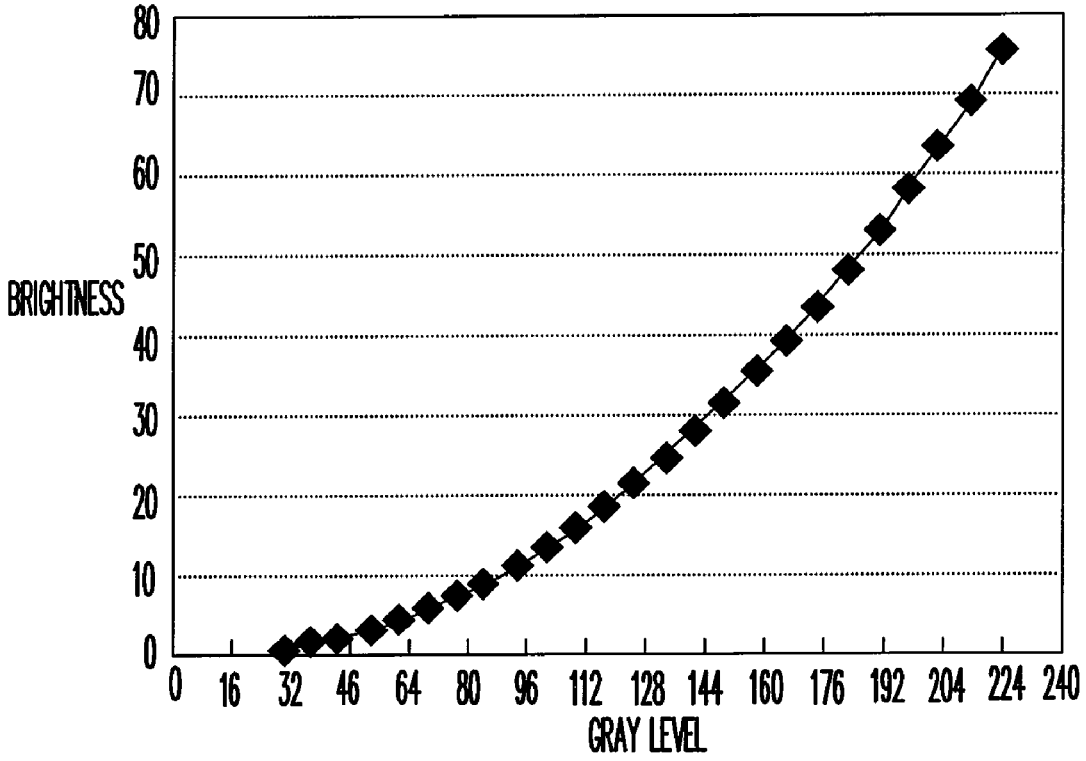
FIG. 3 (PRIOR ART)
FIG. 3 is a figure showing a fixed-mode gamma curve in the prior art.

Reference will now be made in detail to the present preferred embodiments of the invention, examples of which are illustrated in the accompanying drawings. Wherever possible, the same reference numbers are used in the drawings and the description to refer to the same or like parts.

Figure 4A:
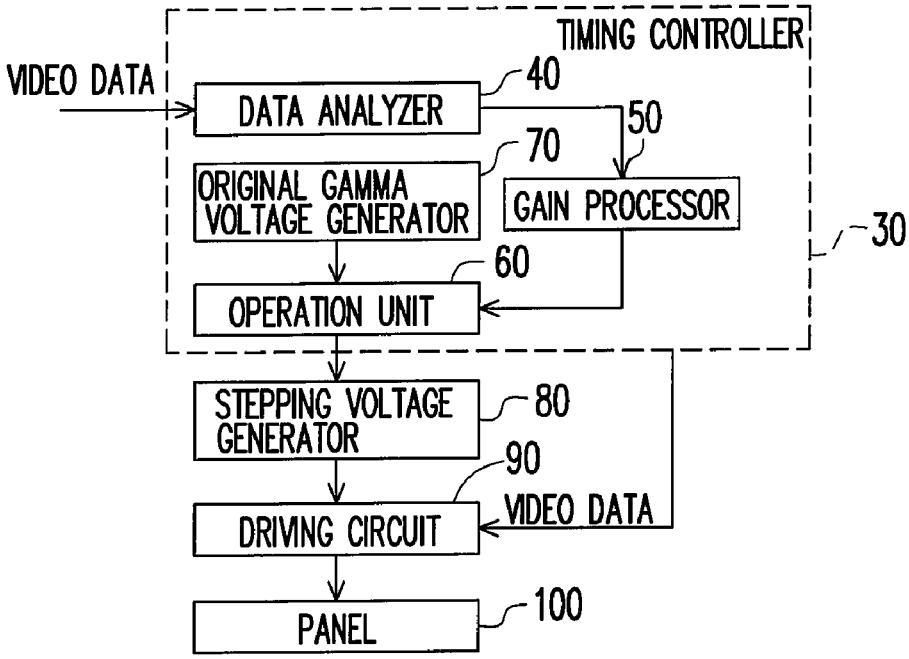
FIG. 4A is a timing controller diagram according to a first embodiment of the present invention.
Figure 4B:
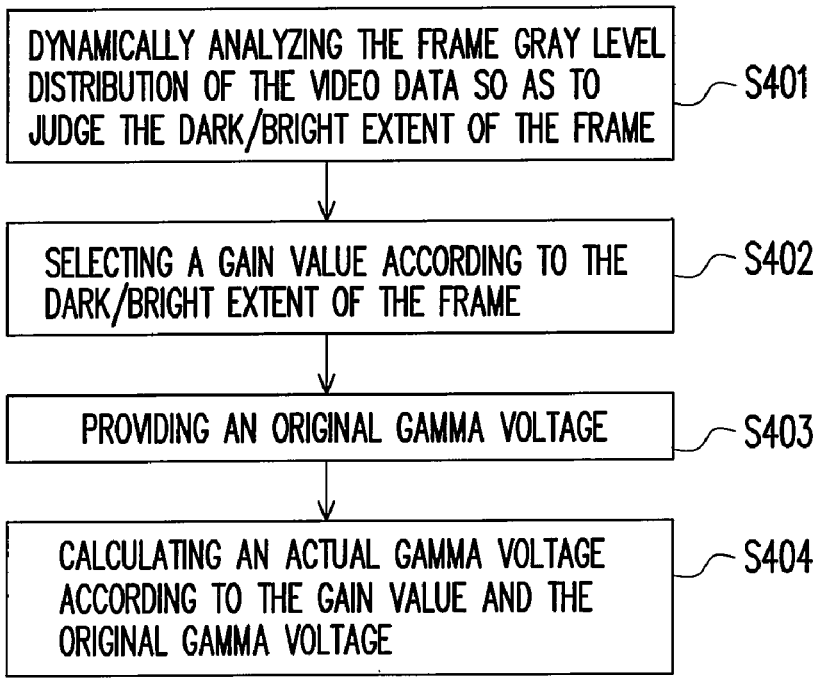
FIG. 4B is a flowchart of a method for adjusting gamma voltage according to the first embodiment of the present invention.

FIG. 4A is a timing controller diagram according to the first embodiment of the present invention, and FIG. 4B is a flowchart of a method for adjusting gamma voltage according to the first embodiment of the present invention. Referring to FIGS. 4A and 4B, a timing controller (TCON) 30 includes a data analyzer 40, a gain processor 50, an original gamma voltage generator 70 and an operation unit 60.

First, in step S401, the data analyzer 40 receives video data and dynamically analyzes the image gray level distribution of the video data so as to judge the dark/bright extent of the image. Next, in step S402, the gain processor 50 selects a gain value according to the dark/bright extent of the image. Then, in step S403, the original gamma voltage generator 70 provides an original gamma voltage. Finally, in step S404, the operation unit 60 calculates an actual gamma voltage according to the gain value and the original gamma voltage, and provides the calculated actual gamma voltage to a stepping voltage generator 80, wherein the stepping voltage generator 80 produces a stepping voltage according to the actual gamma voltage, and outputs the stepping voltage to a driving circuit 90. The driving circuit 90 maps and converts the video data according to the stepping voltage so as to make a panel 100 to display an image.

In the embodiment, the panel 100 is exemplarily a liquid crystal display (LCD) panel. In another embodiment, the panel 100 may be a panel of other types, for example, an organic light emitting diode (OLED) panel or a TFT-LCD. In this way, an over-bright image would get darker or an over-dark image would get brighter. In the following, more details regarding each of the comprising parts are described.

Referring to FIG. 4A, the data analyzer 40 after receiving video data would analyze the image to obtain a ratio of the data amount of regions corresponding to proceeding-30% gray levels over the whole data amount of the image and a ratio of the data amount of regions corresponding to following-30% gray levels over the whole data amount of the image. For example, if the gray levels of the video data have levels 0-255, then, the proceeding-30% gray levels are the levels 0-76 (darker regions of a image), while the following-30% gray levels are the levels 179-255 (brighter regions of a image). In other words, the calculated ratio of the data amount of regions corresponding to levels 0-76 over the whole data amount of the image is used to judge the dark-shift extent of the image; the calculated ratio of the data amount of regions corresponding to levels 179-255 over the whole data amount of the image is used to judge the bright-shift extent of the image. By using the approach to analyze the dark/bright extent of the image is able to largely lower the memory usage without performing a statistics on the gray level distribution of the levels 0-255 in the image.

Note that the ratios of the data amount of regions corresponding to proceeding-30% gray levels and following-30% gray levels over the whole data amount of the image mentioned in the embodiment are considered as a specific implementation. Anyone skilled in the art would be able to modify the mentioned proceeding-30% gray levels and following-30% gray levels into proceeding-20% gray levels, and following-20% gray levels or proceeding-20% gray levels and following-20% gray levels, etc. Therefore, the present invention is not limited to the above-mentioned specific implementation. In another embodiment, other methods, for example, luminance histogram method, are also used to judge the dark/bright extent of the image, which is omitted to describe herein.

After that, the gain processor 50 selects a gain value G according to the dark/bright extent of the image. If the most data amount of the image falls in the proceeding-30% gray levels, a negative gain value G is selected for a gain compensation; if the most data amount of the image falls in the following-30% gray levels, a positive gain value G is selected for a gain compensation; if the gray level distribution of the image is normal, no gain compensation is conducted. The gain value G is determined depending on the ratio of the data amount of regions corresponding to proceeding-30% gray levels over the whole data amount of the image and the ratio of the data amount of regions corresponding to following-30% gray levels over the whole data amount of the image. For example, the gain value G is selected referring to table 1 and table 2.

TABLE 1

Selections of gain value G corresponding to dark images

| ratio (%) of the accumulated data amount corresponding to the darker regions within a dark-shift image over the whole data amount of the image | gain value G |
|---|---|
| 76%-80% | −2% |
| 81%-85% | −4% |
| 86%-90% | −6% |
| 91%-95% | −8% |
| 96%-100% | −10% |

TABLE 2

Selections of gain value G corresponding to bright images

| ratio (%) of the accumulated data amount corresponding to the brighter regions within a bright-shift image over the whole data amount of the image | gain value G |
|---|---|
| 76%-80% | 2% |
| 81%-85% | 4% |
| 86%-90% | 6% |
| 91%-95% | 8% |
| 96%-100% | 10% |

In order to avoid a image color distortion due to a too large gain value G or a too small gain value G, the selection scope of gain value G is defined by ±10% so as to get a better bright compensation effect. Although the above-given selections of gain value G provide a feasible solution, but anyone skilled in the art would understand that different manufactures have their own and different from the others selection scope of gain value G, therefore, the above-given selections do not limit the present invention and they are able to be modified to meet an application practice.

According to the above description, the gain processor 50 outputs the gain value G to the operation unit 60. Besides, the original gamma voltage generator 70 provides the operation unit 60 with the original gamma voltage as well. For example, the original gamma voltage includes voltages $V_1$-$V_{10}$ and a common voltage $V_{com}$, wherein $V_1$-$V_5$ are positive gamma voltages, while $V_6$-$V_{10}$ are negative gamma voltages and the above-mentioned voltages are subjected to $V_1>V_2>V_3>V_4>V_5>V_{com}>V_6>V_7>V_8>V_9>V_{10}$. To distinguish the positive gamma voltages from the negative gamma voltages makes the liquid crystal molecular of the panel 100 convenient to turn over the polarities thereof, for example, to switch the polarities between positive and negative. In the embodiment, the original gamma voltages exemplarily include 10 voltages ($V_1$-$V_{10}$) and a common voltage $V_{com}$. In other embodiments, the gamma voltages allow to be divided into a different number of voltages.

Thereafter, the operation unit 60 calculates an actual gamma voltage according to the gain value G and the original gamma voltage; for example, the positive actual gamma voltage may be calculated according to the original gamma voltages $V_1$-$V_5$ and the following equation (1) or the positive actual gamma voltage may be calculated according to the original gamma voltages $V_6$-$V_{10}$ and the following equation (2):

$$V'_m=V_m+(V_m-V_{com}-\Delta V_p)\times G \quad (1)$$

In the equation (1), $V'_m$ represents any positive voltage within the actual gamma voltages, $V_m$ represents any positive voltage within the original gamma voltages (in the embodiment, $V_{com}$ includes $V_1$-$V_5$), $V_{com}$ represents a common voltage, $\Delta V_p$ represents a compensation voltage to compensate a through voltage and G is a gain value.

$$V'_n=V_n-(V_{com}-V_n+\Delta V_p)\times G \quad (2)$$

In the equation (2), $V'_n$ represents any negative voltage within the actual gamma voltages, $V_n$ represents any negative voltage within the original gamma voltages (in the embodiment, $V_n$ includes $V_6$-$V_{10}$), $V_{com}$ represents a common voltage, $\Delta V_p$ represents a compensation voltage to compensate a through voltage and G is a gain value. Note that the above-mentioned equations (1) and (2) do not limit the present invention. Any appropriate modifications of the equations (1) and (2) are allowed to meet an application demand.

Figure 5A:
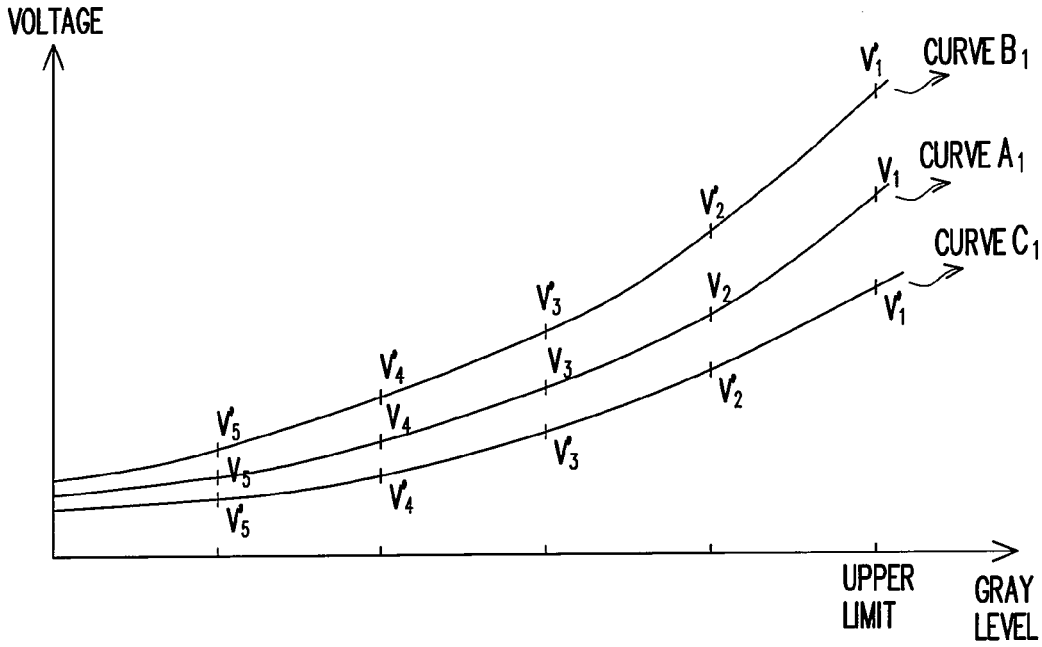
FIG. 5A is a diagram showing converting positive original gamma voltages into actual gamma voltages according to the first embodiment of the present invention.
Figure 5B:
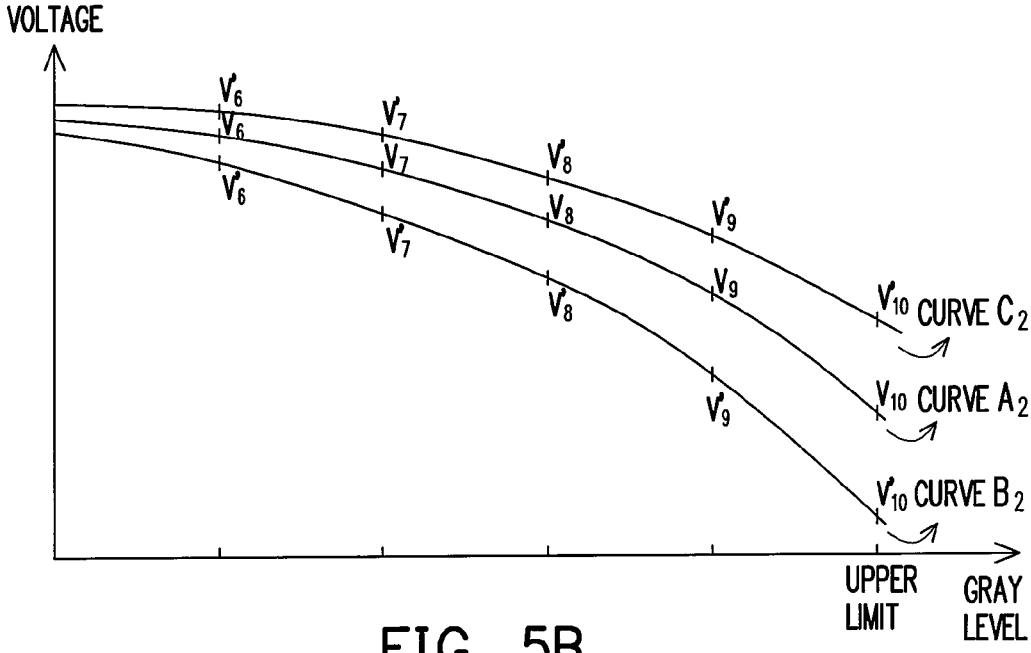
FIG. 5B is a diagram showing converting negative original gamma voltages into actual gamma voltages according to the first embodiment of the present invention.

FIG. 5A is a diagram showing converting positive original gamma voltages into actual gamma voltages according to the first embodiment of the present invention and FIG. 5B is a diagram showing converting negative original gamma voltages into actual gamma voltages according to the first embodiment of the present invention. In the embodiment, the panel 100 is exemplarily normally white type, i.e., when no voltage applies to the liquid crystal molecular of the panel 100, a bright image is presented. Referring to FIG. 5A, the curve $A_1$ represents positive original gamma voltages. When the gain value G takes a positive value, the actual gamma voltages would be higher than the original gamma voltages, for example, the actual gamma voltages are represented by the curve $B_1$; when the gain value G is a negative value, the actual gamma voltages would be lower than the original gamma voltages, for example, the actual gamma voltages are represented by the curve $C_1$.

Referring to FIG. 5B, the curve $A_2$ represents negative original gamma voltages. When the gain value G is a positive value, the actual gamma voltages would be lower than the original gamma voltages, for example, the actual gamma voltages are represented by the curve $B_2$; when the gain value G is a negative value, the actual gamma voltages would be higher than the original gamma voltages, for example, the actual gamma voltages are represented by the curve $C_2$.

A practical implementation can be fulfilled according to the spirit of the present invention and the above-described instructions in the given embodiments and by modifying the given implementations. For example, to suit a panel in normally black type, the gain value corresponding to a dark-shift image should be changed to a positive value; while for a bright-shift image, the gain value should be a negative value.

Further, the operation unit 60 outputs the actual gamma voltage to the stepping voltage generator 80, and the stepping voltage generator 80 produces a new stepping voltage provided to the driving circuit 90 for converting the video data into a driving voltage according to the actual gamma voltage. The driving circuit 90 is, for example, a source driving circuit, and the driving circuit 90 uses an internal digital analog converter (DAC) to convert the video data into the driving voltage so as to drive the panel 100 for display an image. In other words, the presented embodiment converts an original gamma voltage into an actual gamma voltage according to the dark/bright extent of the video data and uses the actual gamma voltage to map and convert the video data into a driving voltage to display an image, which largely advances the display quality.

Figure 6:
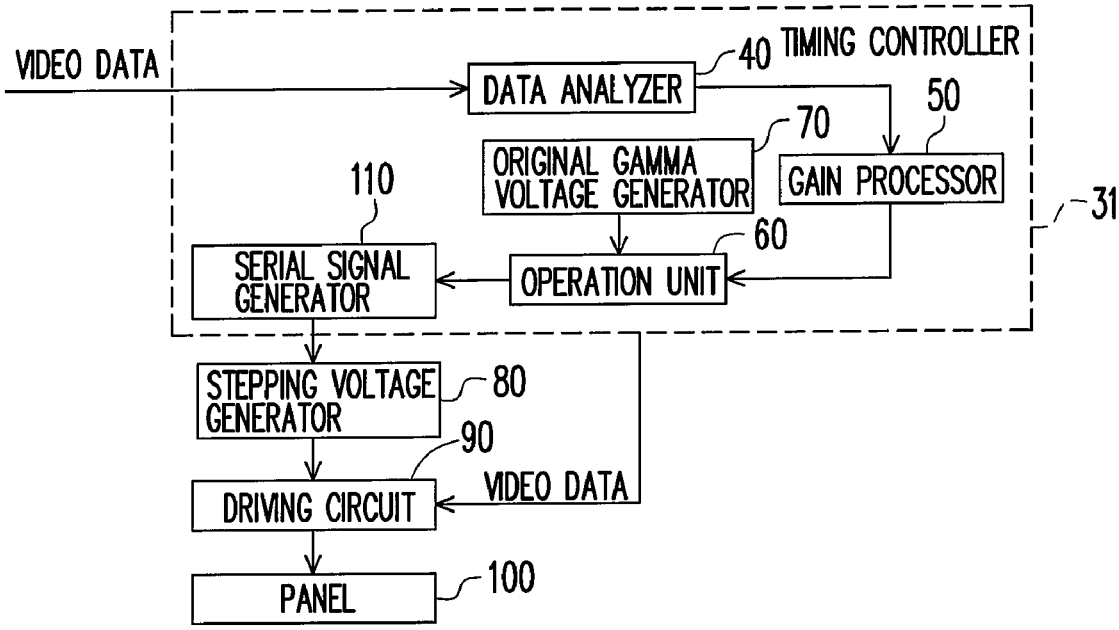
FIG. 6 is another timing controller diagram according to the first embodiment of the present invention.

Anyone skilled in the art would be able to change the architecture of the TCON 30 based on the practical requirement according to the spirit of the present invention and the instructions of the above-given embodiments. For example, FIG. 6 is another timing controller diagram according to the first embodiment of the present invention. Referring to FIG. 6, the data analyzer 40, the gain processor 50, the operation unit 60, the original gamma voltage generator 70, the stepping voltage generator 80, the driving circuit 90 and the panel 100 herein are the same as the embodiment shown by FIG. 4A, thus, they are omitted to describe.

Note that a TCON 31 in FIG. 6 further includes a serial signal generator 110 coupled between the operation unit 60 and the stepping voltage generator 80. By using a sequence delivery manner, the serial signal generator 110 delivers the actual gamma voltage from the operation unit 60 to the stepping voltage generator 80. Anyone skilled in the art should understand that the sequence delivery scheme is a specific implementation only; in another embodiment however, other delivery schemes are allowed for delivering the actual gamma voltage. In this way, an over-dark or an over-bright image can be improved.

Figure 7:
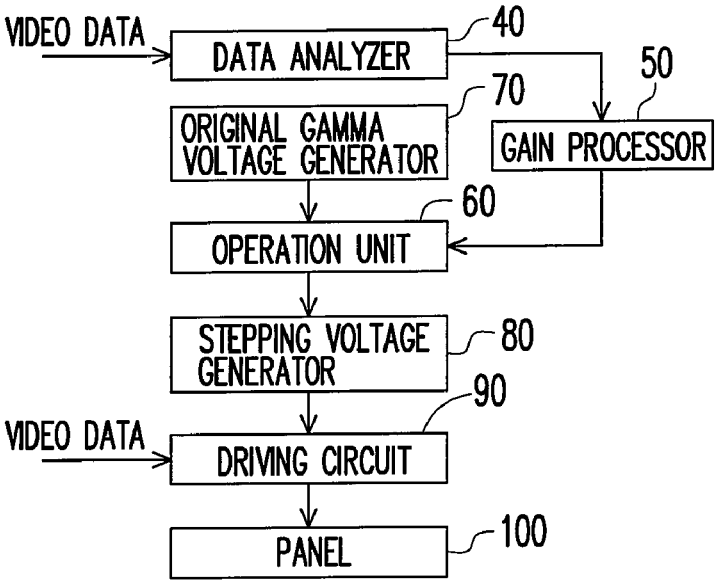
FIG. 7 is a display device diagram according to a second embodiment of the present invention.
Figure 8:
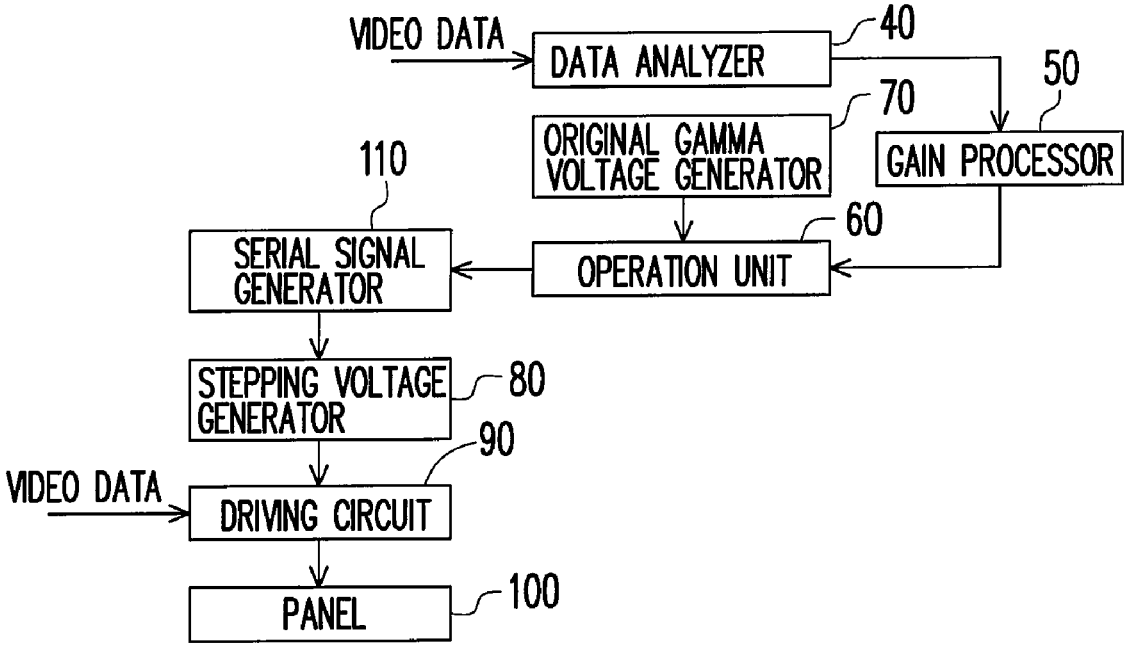
FIG. 8 is another display device diagram according to the second embodiment of the present invention.

In FIG. 4A, the data analyzer 40, the gain processor 50, the operation unit 60 and the original gamma voltage generator 70 are disposed, but not limited by the present invention, in the TCON 30, for example, FIG. 7 is a display device diagram according to the second embodiment of the present invention, where the serial signal generator 110 is disposed at a changed position. In the same way, FIG. 8 is another display device diagram according to the second embodiment of the present invention, where the serial signal generator 110 is disposed at another changed position and the display device has a better display quality to suit the dark/bright extent of the video data. In short, once the original gamma voltage is converted into an actual gamma voltage so as to compensate an over-dark or an over-bright image according to the dark/bright extent of the video data of the video data, the architecture has fallen in the spirit of the present invention already.

In summary, the present invention has at least following advantages:

1. The present invention makes the data analyzer, the gain processor, the original gamma voltage generator and the operation unit disposed in the TCON, and uses a cheaper digital circuit to improve an over-dark or an over-bright image, thus, the production cost can be largely saved.

2. The present invention converts the original gamma voltage into an actual gamma voltage according to the dark/bright extent of the video data so as to improve an over-dark or an over-bright image without adjusting the video data, which significantly simplifies the gamma correction.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A timing controller, comprising:

a data analyzer, dynamically analyzing the gray level distribution of an image of video data so as to judge the dark/bright extent of the image;

a gain processor, coupled to the data analyzer for selecting a gain value according to the dark/bright extent of the image;

an original gamma voltage generator, for providing an original gamma voltage; and an operation unit, coupled to the gain processor and the original gamma voltage generator for calculating an actual gamma voltage and providing the calculated result to a stepping voltage generator according to the gain value and the original gamma voltage, wherein the operation unit calculates a positive voltage of the actual gamma voltages according to an equation $V'_m=V_m+(V_m-V_{com}-\Delta V_p)\times G$, and $V'_m$ represents any positive voltage within the actual gamma voltages, $V_m$ represents any positive voltage within the original gamma voltages, $V_{com}$ represents a common voltage, $\Delta V_p$ represents a compensation voltage and G is a gain value.

2. The timing controller according to claim 1, wherein the stepping voltage generator is coupled to the timing controller and produces a stepping voltage according to the actual gamma voltage for mapping and converting the video data into a driving voltage.

3. The timing controller according to claim 1, further comprising a serial signal generator coupled between the operation unit and the stepping voltage generator, wherein the serial signal generator uses a sequence means to deliver the actual gamma voltage from the operation unit to the stepping voltage generator.

4. The timing controller according to claim 1, wherein the data analyzer performs a statistics on the gray level distribution of the image to obtain a ratio of the data amount of the dark gray level regions over the whole data amount of the image and a ratio of the data amount of the bright gray level regions over the whole data amount of the image so as to judge the dark/bright extent of the image.

5. The timing controller according to claim 1, wherein the operation unit calculates a negative voltage of the actual gamma voltages according to an equation $V'_n=V_n+(V_{com}-V_n+\Delta V_p)\times G$, wherein $V'_n$ represents any negative voltage within the actual gamma voltages, $V_n$ represents any negative voltage within the original gamma voltages, $V_{com}$ represents a common voltage, $\Delta V_p$ represents a compensation voltage and G is a gain value.

6. A display device, comprising:

a data analyzer, dynamically analyzing the gray level distribution of an image of video data so as to judge the dark/bright extent of the image;

a gain processor, coupled to the data analyzer for selecting a gain value according to the dark/bright extent of the image;

an original gamma voltage generator for providing an original gamma voltage;

an operation unit, coupled to the gain processor and the original gamma voltage generator for calculating an actual gamma voltage;

a stepping voltage generator, producing a stepping voltage according to the actual gamma voltage, wherein the operation unit calculates a positive voltage of the actual gamma voltages according to an equation $V'_m=V_m+(V_m-V_{com}-\Delta V_p)\times G$, and $V'_m$ represents any positive voltage within the actual gamma voltages, $V_m$ represents any positive voltage within the original gamma voltages, $V_{com}$ represents a common voltage, $\Delta V_p$ represents a compensation voltage and G is a gain value;

a driving circuit, coupled to the stepping voltage generator, wherein the driving circuit maps and converts the video data into a driving voltage according to the stepping voltage; and a panel, coupled to the driving circuit, for receiving the driving voltage to display an image.

7. The display device according to claim 6, further comprising a serial signal generator coupled between the operation unit and the stepping voltage generator, wherein the serial signal generator uses a sequence means to deliver the actual gamma voltage from the operation unit to the stepping voltage generator.

8. The display device according to claim 6, wherein the data analyzer performs a statistics on the gray level distribution of the image to obtain a ratio of the data amount of the dark gray level regions over the whole data amount of the image and a ratio of the data amount of the bright gray level regions over the whole data amount of the image so as to judge the dark/bright extent of the image.

9. The display device according to claim 6, wherein the operation unit calculates a negative voltage of the actual gamma voltages according to an equation $V'_n=V_n+(V_{com}-V_n+\Delta V_p)\times G$, wherein $V'_n$ represents any negative voltage within the actual gamma voltages, $V_n$ represents any negative voltage within the original gamma voltages, $V_{com}$ represents a common voltage, $\Delta V_p$ represents a compensation voltage and G is a gain value.

10. A method for adjusting gamma voltage, comprising:

dynamically analyzing the gray level distribution of an image of video data to judge the dark/bright extent of the image;

selecting a gain value according to the dark/bright extent of the image;

providing an original gamma voltage; and calculating an actual gamma voltage according to the gain value and an original gamma voltage; and calculating a positive voltage of the actual gamma voltages according to an equation $V'_m=V_m+(V_m-V_{com}-\Delta V_p)\times G$, wherein $V'_m$ represents any positive voltage within the actual gamma voltages, $V_m$ represents any positive voltage within the original gamma voltages, $V_{com}$ represents a common voltage, $\Delta V_p$ represents a compensation voltage and G is a gain value.

11. The method for adjusting gamma voltage according to claim 10, wherein the step of dynamically analyzing the gray level distribution of an image of the video data to judge the dark/bright extent of the image further comprises:

performing a statistical analysis on the gray level distribution of the image to obtain a ratio of the data amount of the dark gray level regions over the whole data amount of the image and a ratio of the data amount of the bright gray level regions over the whole data amount of the image so as to judge the dark/bright extent of the image.

12. The method for adjusting gamma voltage according to claim 10, wherein the step of calculating an actual gamma voltage according to the gain value and an original gamma voltage comprises:

calculating a negative voltage of the actual gamma voltages according to an equation $V'_n=V_n+(V_{com}-V_n+\Delta V_p)\times G$, wherein $V'_n$ represents any negative voltage within the actual gamma voltages, $V_n$ represents any negative voltage within the original gamma voltages, $V_{com}$ represents a common voltage, $\Delta V_p$ represents a compensation voltage and G is a gain value.

* * * * *